US005528985A

United States Patent [19]

Haller

[11] Patent Number: 5,528,985

[45] Date of Patent: Jun. 25, 1996

[54] ALIGNMENT MONITORING DEVICE ON ROTARY PRINTING MACHINES

[75] Inventor: Ralf Haller, Oftersheim, Germany

[73] Assignee: Heidelberger Druckmaschinen AG, Heidelberg, Germany

[21] Appl. No.: 227,304

[22] Filed: Apr. 13, 1994

Related U.S. Application Data

[63] Continuation of Ser. No. 970,089, Nov. 2, 1992, abandoned.

[30] Foreign Application Priority Data

Nov. 2, 1991 [DE] Germany ..... 41 36 236.5

[51] Int. Cl.[6] ..... B41F 13/00

[52] U.S. Cl. ..... 101/216

[58] Field of Search ..... 101/216, 485, 101/486, 480, 181, 183; 100/99; 33/370, 371, 372, 373, 451, 365, 366, 379

[56] References Cited

U.S. PATENT DOCUMENTS

| | | | |
|---|---|---|---|
| 2,856,696 | 10/1958 | Williams | 33/373 |
| 3,390,633 | 7/1968 | Boughton | 101/216 |
| 3,770,299 | 11/1973 | Murphy | 280/507 |
| 4,154,000 | 5/1979 | Kramer | 33/366 |
| 4,501,057 | 2/1985 | Palomera | 33/371 |
| 4,542,592 | 9/1985 | Hopkins | 33/371 |
| 4,547,972 | 10/1985 | Heidel et al. | 33/366 |
| 4,567,666 | 2/1986 | Neis et al. | 33/366 X |
| 4,942,386 | 7/1990 | Willis | 340/566 |
| 5,079,847 | 1/1992 | Swartz et al. | 33/366 |
| 5,201,272 | 4/1993 | Simon | 101/485 |

FOREIGN PATENT DOCUMENTS

| | | |
|---|---|---|
| 45947 | 2/1966 | Germany . |
| 1448708 | 8/1970 | Germany . |
| 8307203 | 7/1983 | Germany . |
| 809846 | 3/1959 | United Kingdom . |

OTHER PUBLICATIONS

"BW–Fixfitor" No. 3000, Sep. 1990, pp. 17 & 25.

*Primary Examiner*—J. Reed Fisher

*Attorney, Agent, or Firm*—Herbert L. Lerner; Laurence A. Greenberg

[57] ABSTRACT

An alignment monitoring device on rotary printing machines includes a plurality of installed components, respectively, having at least one alignment indicator applied thereto, the alignment indicator having equipment for indicating permissible tolerances for positional deviations of the respective installed component, and equipment for indicating positional deviations incurred by the respective installed component, and a device for protecting the alignment indicator against being manipulated.

8 Claims, 3 Drawing Sheets

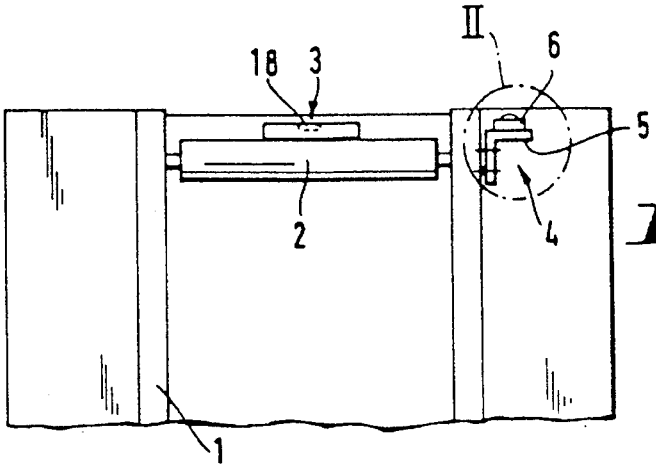
Fig. 2
Fig. 3
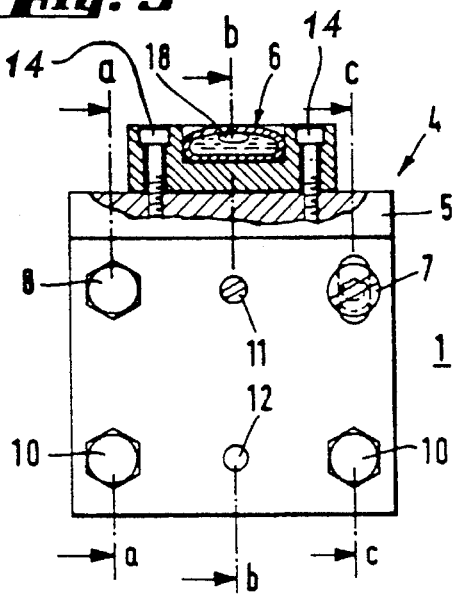
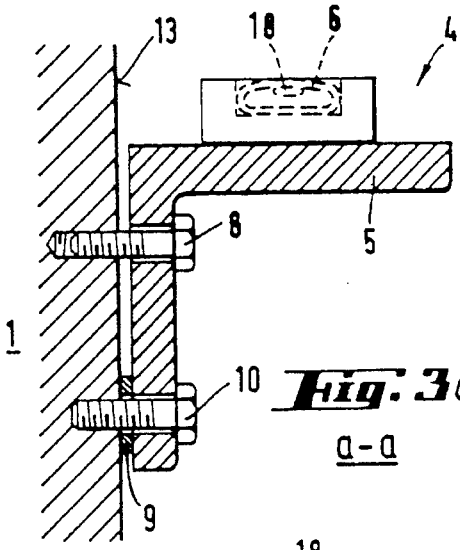
Fig. 3a
a-a
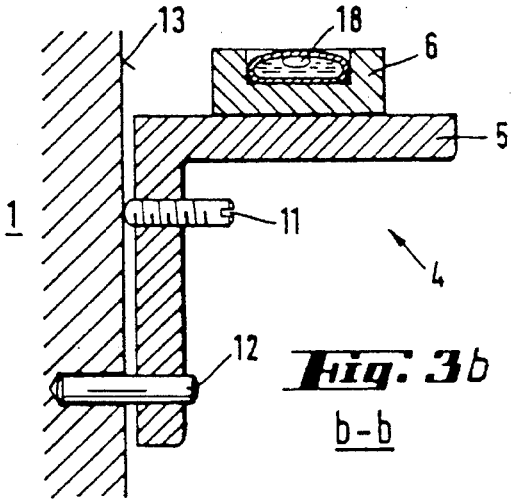
Fig. 3b
b-b
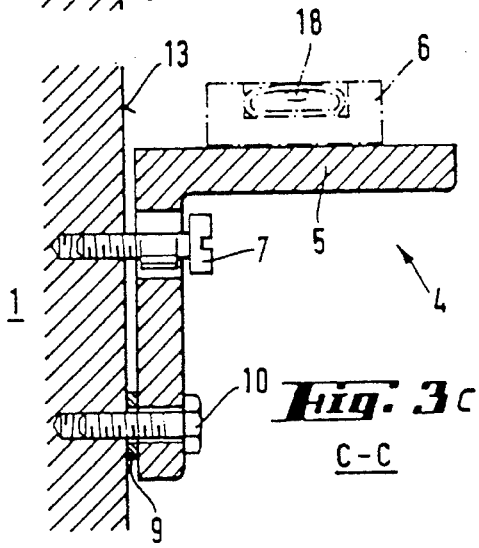
Fig. 3c
c-c

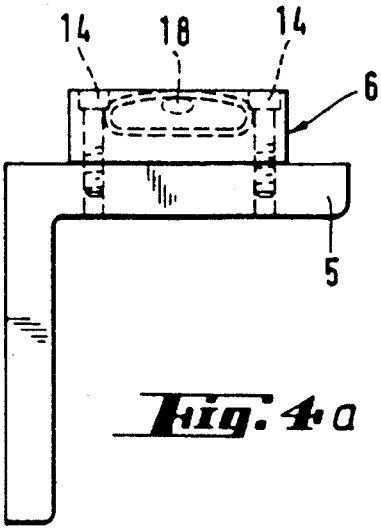
Fig. 4a
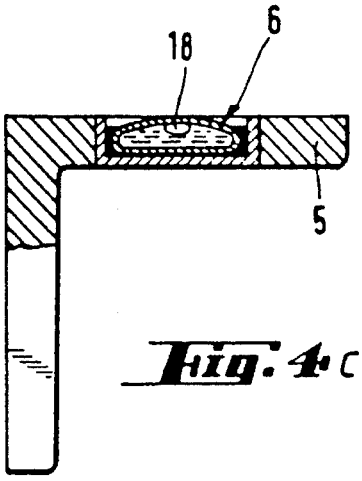
Fig. 4c
Fig. 4b
Fig. 4d
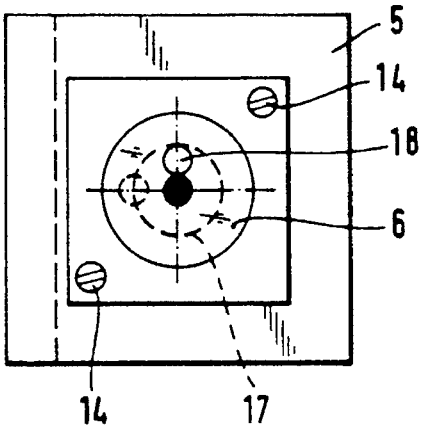
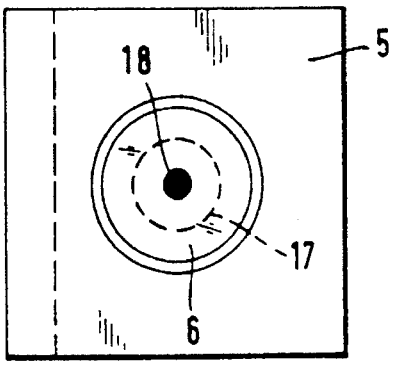
Fig. 5a
Fig. 5b
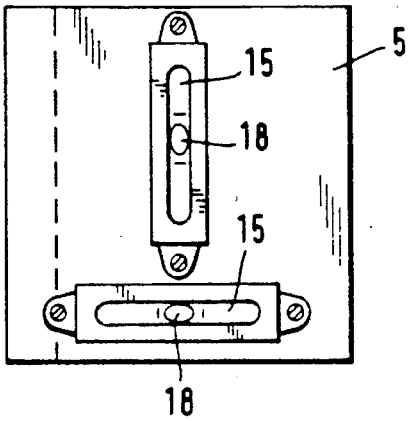
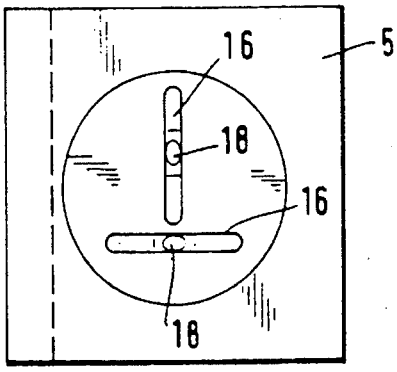

ALIGNMENT MONITORING DEVICE ON ROTARY PRINTING MACHINES

This application is a continuation of application Ser. No. 07/970,089, filed Nov. 2, 1992, now abandoned.

The invention relates to an alignment monitoring device on rotary printing machines.

Individual components of a rotary printing machine are installed or erected and aligned by means of high-precision spirit levels and adjusting screws at the premises of a customer. After installation or erection, the measuring instruments are removed, the printing machine is tested by the customer prior to acceptance, and the printing machine then commences operation at the customer's premises. After a period of operation of the printing machine and as a result of dynamic loading occurring during the operation thereof, the foundation supplied by the customer for supporting the printing machine, or the floor below the foundation becomes deformed. Settling phenomena and undesired tilting or inclination of individual components of the printing machine result therefrom. The high-grade gearwheels with which the machine components are mutually connected at the drive end, and the bearings thereof withstand only a slight amount of positional deviation. Excessive positional deviation will alter the wear pattern of one of the gearwheel pairs. If any damage should be sustained, ascertainment of the cause thereof involves making a survey of the machine and taking appropriate measurements, which is both very time-consuming and very expensive. It is not uncommon for shutdown times of the printing machine to be as much as one week or more.

Starting from the aforementioned state of the art, it is an object of the invention to provide an alignment monitoring device which detects deviations from a precise initial installation or erection position of individual components of the printing machine, and prevents the occurrence of long downtime periods.

With the foregoing and other objects in view, there is provided, in accordance with the invention, an alignment monitoring device on rotary printing machines, comprising a plurality of installed components, respectively, having at least one alignment indicator applied thereto, the alignment indicator having means for indicating permissible tolerances for positional deviations of the respective installed component, and means for indicating positional deviations incurred by the respective installed component, and including means for protecting the alignment indicator against being manipulated.

An advantage of this construction is that, by detecting or determining the indicated values and comparing them with the respectively permissible tolerances, one can economize on or dispense with a time-consuming measurement performed on the printing machine. Moreover, the protection against manipulation by unauthorized persons permits actual relative movements between individual installed or erected components to be determined rapidly which, in turn, permits speedy clarification of warranty-related matters.

In accordance with another feature of the invention, the means for indicating permissible tolerances and the means for indicating positional deviations are equipped for indicating permissible tolerances and positional deviations in two planes. Rapid detection or determination of the positional deviations of individual printing-machine components relative to one another is thereby afforded.

In accordance with a further feature of the invention, the alignment indicator is an annular spirit level.

In accordance with an alternative feature of the invention, the alignment indicator comprises at least one rectilinear spirit level.

In accordance with yet another alternative feature of the invention, the alignment indicator comprises at least one annular spirit level and at least one rectilinear spirit level.

In accordance with an added feature of the invention, the alignment indicator comprises two rectilinear spirit levels disposed perpendicularly to one another.

In addition to the low construction costs of spirit levels of the foregoing types, they provide indications of the highest accuracy.

In accordance with a concomitant feature of the invention, the printing machine has a control system, and means are provided which are responsive to the alignment indicator for transmitting electrical pulses to the control system, for example, when permissible tolerances of positional deviation are exceeded.

Accordingly, damage to the printing machine can be avoided, because positional deviations are detected or determined sufficiently early beforehand.

Other features which are considered as characteristic for the invention are set forth in the appended claims.

Although the invention is illustrated and described herein as embodied in an alignment monitoring device in rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is an enlarged fragmentary view of FIG. 1 showing an installation or erection component with an alignment monitoring device according to the invention;

FIG. 3 is a much-enlarged fragmentary view of FIG. 2, as seen from the right-hand side thereof, showing, partly in section, an alignment indicator located within the phantom circle II in FIG. 2;

Figure 1:
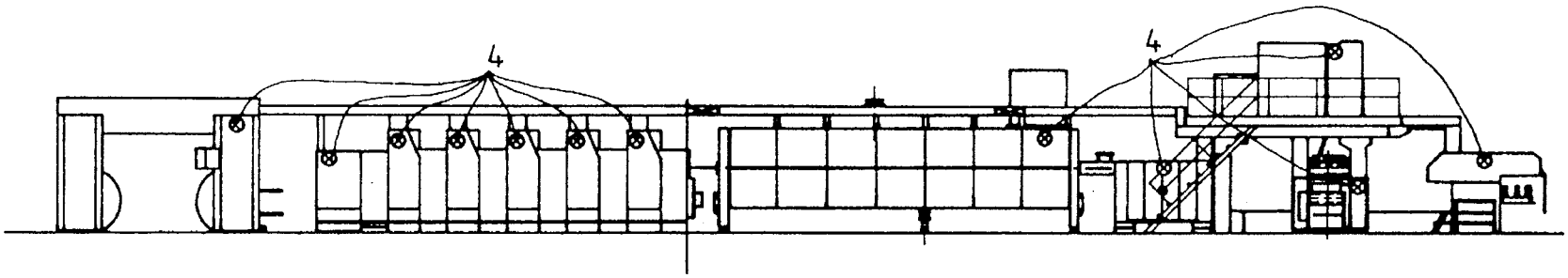
FIG. 1 is a diagrammatic side elevational view of a web printing machine incorporating therein alignment monitoring devices according to the invention.

FIGS. 3*a*, 3*b* and 3*c* are cross-sectional views taken along the lines a—a, b—b and c—c, respectively, in the direction of the arrows;

FIGS. 4*a* and 4*b* are respective side elevational and top plan views of another embodiment of the alignment indicator with a ring-type spirit or bubble level;

FIGS. 4*c* and 4*d* are respective side elevational, partly in section, and top plan views of yet another embodiment of the alignment indicator with a ring-type spirit or bubble level; and FIGS. 5*a* and 5*b* are top plan views of two additional embodiments of the alignment indicator, each having rectilinear vertical and horizontal spirit or bubble levels.

Referring now to the drawings and, first, particularly to FIG. 1 thereof, a web-fed printing machine is shown therein, in a side elevational view. Respective alignment indicators 4, in accordance with the invention, are applied to individual aligned or erected components 1 and provide information regarding positional deviations of the individual components 1 relative to one another. Conventional components of the web-fed printing machine, such as a paper-feeding unit and an automatic paster or reel changer or splicer, as well as individual printing units, thus have alignment indicators 4. At an end of a conventional dryer of the web-fed printing machine, alignment indicators 4 are located on a set of cooling rollers and on a turning-bar superstructure. Furthermore, both a cylinder part of a folding machine and an open sheet delivery disposed downstream of the printing machine in the travel direction of the sheets are, respectively, provided with an alignment indicator 4.

An erected or installed component 1 having an alignment indicator 4 attached to a side thereof is shown in FIG. 2. Initial alignment of the installed component 1 is effected by means of precision spirit levels 3 which permit precise initial alignment of the installed component 1, for example, with respect to the position of an ink duct roller 2.

After an initial alignment of several installed or erected components 1 has been performed and has been found to be satisfactory, this constellation of alignments is secured by an alignment indicator 4, as shown in FIGS. 3, 3*a*, 3*b* and 3*c*. This means that the alignment indicators 4 on the respective erected or installed components 1 are calibrated so that the position of initial alignment which was found to be satisfactory serves as the reference position for the respective erected or installed component 1. For that purpose, when spirit levels 3 are used, the enclosed air bubbles are located in the middle of the annular or rectilinear scale thereof.

As is apparent in FIG. 3, an annular or ring-type spirit level 6 is fastened onto a supporting angle 5 by bolts 14. The supporting angle 5, which is mounted on a side wall 13 of the respective installed or erected component 1, is adjustable both in horizontal as well as vertical direction. The supporting angle 5 is connected by two assembly screws 10, through the intermediary of spacer washers 9, to the side wall 13 of the installed component 1, and is also connected thereto by an assembly screw 8 but without the intervention of any spacer, thereby permitting an adjustment of the supporting angle 5 in a counterclockwise direction towards the side wall 13, as viewed in FIG. 3*a*, for example.

As shown more clearly in the cross-sectional view of FIG. 3*b*, by providing a setscrew 11 braced against the side wall 13, the position of the supporting angle 5 may, for one, be fixed perpendicularly to the side wall 13, and may, for another, be adjustable in clockwise direction. As shown more particularly in FIG. 3*c*, an eccentric bolt 7 also connecting the supporting angle 5 to the side wall 13 can be turned, when the assembly screws 8 and 10 are loosened, so as to permit the supporting angle 5 to be turned about an adjusting pin 12 (FIG. 3*b*). After the supporting angle 5 has been adjusted, the assembly screws 10 are tightened, and the position of the supporting angle 5 is checked again. The initial alignment position is thus "stored" as a reference point in the alignment indicators 4.

Tilting of the installed or erected component 1 about a transverse axis and, likewise, a lowering of the side wall 13 in vertical direction can be detected. The so-called "travel" of an erected or installed component 1 about its own vertical axis is demonstrable by a comparison of two mutually opposing alignment indicators 4. Manipulation of adjustment devices for the alignment indicators or marks 4 can be prevented, in one regard, by placing the latter only at locations which are accessible only to the printing-machine manufacturer during the initial erection or installation of the printing machine. In another regard, the positions of the setscrew 11 and the eccentric bolt 7 can be sealed, for example, by lead sealing or caulking, after the adjustment and storage of the reference position which was found to be satisfactory.

FIGS. 4*a* and 4*b* illustrate an embodiment of an alignment indicator 4 wherein an annular or ring-type spirit level 6 is fastened onto a supporting angle 5 by screw or bolts 14. A broken line 17 represents, in FIG. 4*b*, a tolerance limit within which deviations in the alignment of the erected or installed component 1 can be tolerated. Conversely, in FIGS. 4*c* and 4*d*, an annular or ring-shaped spirit level 6 is shown recessed into a supporting angle 5. This offers an additional advantage in that no relative movements between the supporting angle 5 and the annular spirit level 6 can occur.

FIGS. 5*a* and 5*b* show two configurations of another embodiment of the invention wherein, instead of an annular spirit level, a combination of two rectilinear spirit-level tubes 15 or 16, respectively, oriented perpendicularly to one another, is employed. In FIG. 5*a*, the tubes 15 are bolted to the supporting angle 5 whereas, in FIG. 5*b*, the tubes 16 are recessed into the supporting angle 5.

I claim:

1. A combination comprising a rotary printing machine and at least one alignment monitoring device for alignment monitoring of the rotary printing machine, the printing machine including a plurality of installed components, wherein at least one of the installed components includes at least one alignment monitoring device; said alignment monitoring device including means for indicating positional deviations of said components from the time of installation of the printing machine in at least two planes; retaining means connected with said alignment monitoring device for retaining said alignment monitoring device in its original position on said installed components, and manipulation securing means connected with said alignment monitoring device for securing said monitoring device against manipulation during operation of said rotary printing machine, wherein said monitoring device is operative for indicating loss of alignment of said installed components from their original aligned positions.

2. The combination according to claim 1, including in said monitoring device means for indicating tolerances, and wherein said monitoring device includes means for indicating tolerances in two planes.

3. The combination according to claim 1, wherein said alignment monitoring device is an annular spirit level.

4. The combination according to claim 1, wherein said alignment monitoring device comprises at least one rectilinear spirit level.

5. The combination according to claim 1, wherein said alignment monitoring device comprises at least one annular spirit level and at least one rectilinear spirit level.

6. The combination according to claim 1, wherein said alignment monitoring device comprises two rectilinear spirit levels disposed perpendicularly to one another.

7. Device according to claim 1, wherein said retaining means include sealing means in operative engagement with said alignment monitoring device for sealing said alignment monitoring device in a sealed position.

8. Device according to claim 7, wherein said sealing means include at least one of lead sealing and caulking.

* * * * *